US008745778B2

(12) United States Patent
Kitfield, Jr.

(10) Patent No.: US 8,745,778 B2
(45) **Date of Patent: *Jun. 10, 2014**

(54) FULLY ARTICULABLE CURTAIN ROD

(76) Inventor: David B. Kitfield, Jr., Pine Lake, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/586,816

(22) Filed: Aug. 15, 2012

(65) Prior Publication Data

US 2013/0276225 A1 Oct. 24, 2013

Related U.S. Application Data

(63) Continuation-in-part of application No. 13/449,694, filed on Apr. 18, 2012.

(51) Int. Cl.
*A47K 3/00* (2006.01)

(52) U.S. Cl.
USPC ..... 4/610

(58) Field of Classification Search
USPC ..... 4/596–614
See application file for complete search history.

(56) References Cited

U.S. PATENT DOCUMENTS

| | | | | |
|---|---|---|---|---|
| 1,844,038 | A * | 2/1932 | Hooker | 4/599 |
| 2,095,645 | A * | 10/1937 | Lewis | 4/607 |
| 3,054,118 | A * | 9/1962 | Bullock | 4/607 |
| 3,418,665 | A * | 12/1968 | Long | 4/610 |
| 6,276,002 | B1 * | 8/2001 | Oschmann | 4/558 |
| 6,302,122 | B1 * | 10/2001 | Parker et al. | 132/333 |
| 7,987,534 | B2 * | 8/2011 | Lin | 4/608 |
| 8,015,633 | B2 * | 9/2011 | Ho | 4/610 |
| 8,201,286 | B1 * | 6/2012 | Parker | 4/609 |
| 2005/0188459 | A1 * | 9/2005 | Lanius | 4/605 |
| 2007/0033729 | A1 * | 2/2007 | Faux | 4/601 |
| 2009/0094737 | A1 * | 4/2009 | Tracey | 4/601 |

* cited by examiner

*Primary Examiner* — Lori Baker

(57) ABSTRACT

Adjustable shower curtain rod designs for providing a shower curtain rod that allows the wet, inner-stall facing side of a shower curtain to be quickly and easily rotated up to 360 degrees. This rotation allows the wet, inner-stall facing side of the shower curtain to be positioned so that it faces out into the room rather than facing the shower stall. This facilitates faster and easier drying of the wet, inner-stall facing side of the shower curtain due to improved airflow and the lower humidity of the room. These features facilitate ease of cleaning and/or inspecting of the shower curtain, while also reducing the opportunity for mold, mildew and bacteria to grow on the curtain as the shower curtain has an improved drying time.

20 Claims, 6 Drawing Sheets

FULLY ARTICULABLE CURTAIN ROD

CROSS REFERENCE TO RELATED APPLICATIONS

This application is a continuation in part (CIP) of application Ser. No. 13/449,694 entitled "Fully Articulable Shower Curtain Rod," filed Apr. 19, 2012, which is incorporated herein by reference in its entirety.

BACKGROUND

Technical Field

The invention is directed generally to shower curtain rods and more particularly, to a shower curtain rod that allows the shower curtain or liner to be easily and quickly turned in-side-out to facilitate faster drying as well as providing other unique features.

Shower curtain rods are well known in the art. Typically they are fixed in place metal, plastic, or wooden rods for holding shower curtains. In a typical configuration, the shower curtain rod is simply a simple rod that is mounted between opposite walls framing the opening to a shower stall or bathtub. These rods are designed to receive shower curtain hooks, which are used to hang a shower curtain or liner from the rod while simultaneously allowing the shower curtain to be moved horizontally fore and aft about the length of the shower curtain rod.

Many shower curtain rods are designed such that they are fixed in place, while the curtain hangs below the rod from the shower curtain hooks. While this allows the shower curtain or liner to be quickly and easily moved horizontally fore and aft about the length of the rod, this arrangement only allows one side of the shower curtain to face the inner shower stall, while the other side of the shower curtain always faces out into the room. The inner side of the shower curtain or liner that faces the inner side of the shower stall or bathtub stall is also the side that normally gets wet when the shower is used. The inner side of the shower curtain must then always face the wet and high humidity inner shower stall as it dries. Unfortunately, this approach can often delay drying of the shower curtain for several hours due to the high humidity of a recently used shower or bathtub stall. This delayed drying of the shower curtain may lead to mold and mildew setting up on the shower curtain.

Many new plastic or vinyl shower curtains and liners are treated with chemicals that are designed to be mold and mildew resistant, however, even these curtains and liners will eventually develop mold and mildew if they are used continuously in a high humidity environment for long periods of time. Furthermore, shower curtains comprised of cotton, polyester, hemp or other natural materials are prone to mold and mildew when used in high humidity shower areas. What is needed is a method for quickly drying the inner stall-facing side of a shower curtain so that it is more resistant to mold and mildew. For example, a shower curtain rod that allows the shower curtain to be rotated 180 degrees so that the wet, inner-stall facing side of a shower curtain or liner can be repositioned so that it is facing the outer bathroom area, rather than the high humidity, inner-shower-stall area is needed. Embodiments described below disclose a shower curtain rod that allows a shower curtain or liner to be quickly rotated 180 degrees so that the wet, inner-stall facing side of a shower curtain or liner can be turned to face the lower humidity bathroom area, rather than the high humidity shower stall area.

There exists a need for a shower curtain rod that allows the inner-stall facing side of a shower curtain or liner to be quickly re-positioned and exposed to the lower humidity areas of the bathroom or room.

SUMMARY OF THE INVENTION

Therefore, embodiments of the present invention disclose a shower curtain rod that allows a shower curtain or liner to be quickly rotated 180 degrees so that the wet, inner-stall facing side of a shower curtain or liner can be turned to face the lower humidity bathroom area, rather than the high humidity shower stall area.

Embodiments include a shower curtain rod having an upper horizontal bar extended between and mounted to the sidewalls of the shower stall. The shower curtain rod further includes a second, lower, substantially rectangular-shaped loop bar suspended from the upper, straight, horizontal bar using a plurality of "J" hooks. Here the lower, rectangular "loop-shaped" bar supports a plurality of "J" hooks for mounting a shower curtain and or liner. The lower, rectangular "loop-shaped" bar allows the shower curtain and/or liner to be pulled and rotated through a full 360 degrees around the rectangular loop. The lower, rectangular "loop-shaped" bar is also lengthwise adjustable on one side or both sides or ends. Therefore the shower curtain or liner can be pulled and rotated around the lower rectangular "loop-shaped" bar such that the wet inner-stall facing side of the shower curtain or liner can face out into the dryer and lower humidity area of the bathroom.

Embodiments further include a shower curtain rod having an upper horizontal rod extended between and mounted to the sidewalls of the shower stall. The shower curtain rod further includes a second, lower lengthwise adjustable shower curtain rod that is attached to the upper horizontal rod via a pivot mechanism mounted near the center of both the upper and lower rods. The lower, shower curtain rod can swing 180-360 degrees relative to the upper horizontal rod about the pivot mechanism. Thus, the lower, shower curtain rod allows the shower curtain and/or liner to be rotated through a full 180 degrees or more about the pivot mechanism and relative to the upper horizontal rod. This allows the shower curtain or liner to be rotated within the bathtub or shower stall area so that the wet inner-stall facing side of the shower curtain or liner can face out into the dryer and lower humidity area of the bathroom.

Finally, another embodiment disclosed herein further includes a shower curtain rod having a horizontal rod shape and extended between and mounted to the sidewalls of the shower stall. A lengthwise adjustable, shower curtain rod is mounted between the sidewalls of the shower stall using a pair of quick release cradles. The quick release cradles are designed to allow the shower curtain rod to be securely mounted to the sidewalls of the shower stall, while also allowing the shower curtain and rod to be quickly and easily removed from the cradles and spun around 180-360 degrees so that the shower curtain can be remounted to allow the wet inner-stall facing side of the shower curtain or liner to face out into the dryer and lower humidity area of the bathroom.

Additional features, advantages, and embodiments of the invention may be set forth or apparent from consideration of the following detailed description, drawings, and claims. Moreover, it is to be understood that both the foregoing summary of the invention and following summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principle of the invention. No attempt is made to show structural details of the invention in more detail than may be necessary for a fundamental understanding of the invention and the various ways in which it may be practiced. In the drawings.

DETAILED DESCRIPTION

Figure 1:
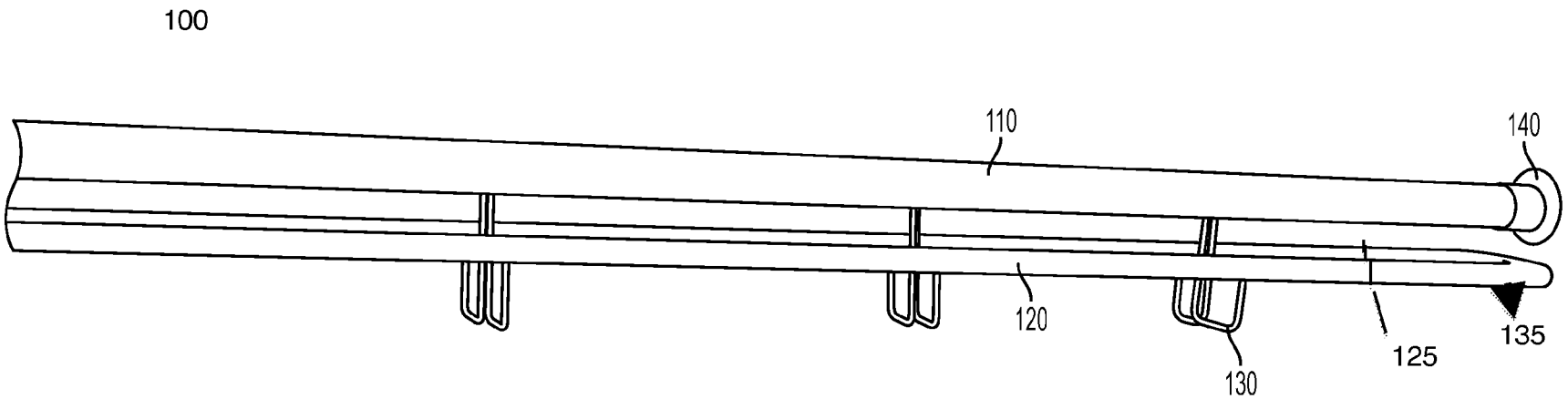
FIG. 1 illustrates a shower curtain rod having a lower rectangular loop rod according to an embodiment of the invention.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Embodiments of the invention and the various features and novel details thereof are explained more fully with reference to the non-limiting embodiments and examples that are described and/or illustrated in the accompanying drawings and details in the following description. It should be noted that the features illustrated in the drawings are not necessarily drawn to scale, and features of one embodiment can be employed with other embodiments, as the skilled artisan would recognize, even if not explicitly stated herein. The examples and embodiments disclosed herein are intended merely to facilitate an understanding of ways in which the invention may be practiced and to further enable those of skill in the art to practice the embodiments of the invention, which is defined solely by the appended claims and applicable law. Moreover, it is noted that like reference numerals represent similar parts throughout the several views of the drawings.

FIG. 1 illustrates a shower curtain rod 100 according to an embodiment. The shower curtain rod 100 comprises an upper horizontal bar 110 extended between and mounted to the sidewalls of the shower stall. In an alternative embodiment, the horizontal bar 110 of the shower curtain rod can be mounted to the sidewalls of the shower curtain rod using mounting cradles 140, such as the ones described in FIG. 6 below. The shower curtain rod 100 further includes a second, lower, substantially rectangular "loop-shaped" bar 120 suspended from the upper, horizontal bar 110 using one or more "J" hooks 130. Here the lower, rectangular "loop-shaped" bar 120 supports a plurality of "S" hooks 150, as illustrated in FIG. 3, for mounting a shower curtain 160 and/or liner 160 to the lower, rectangular "loop-shaped" bar 120.

Figure 2:
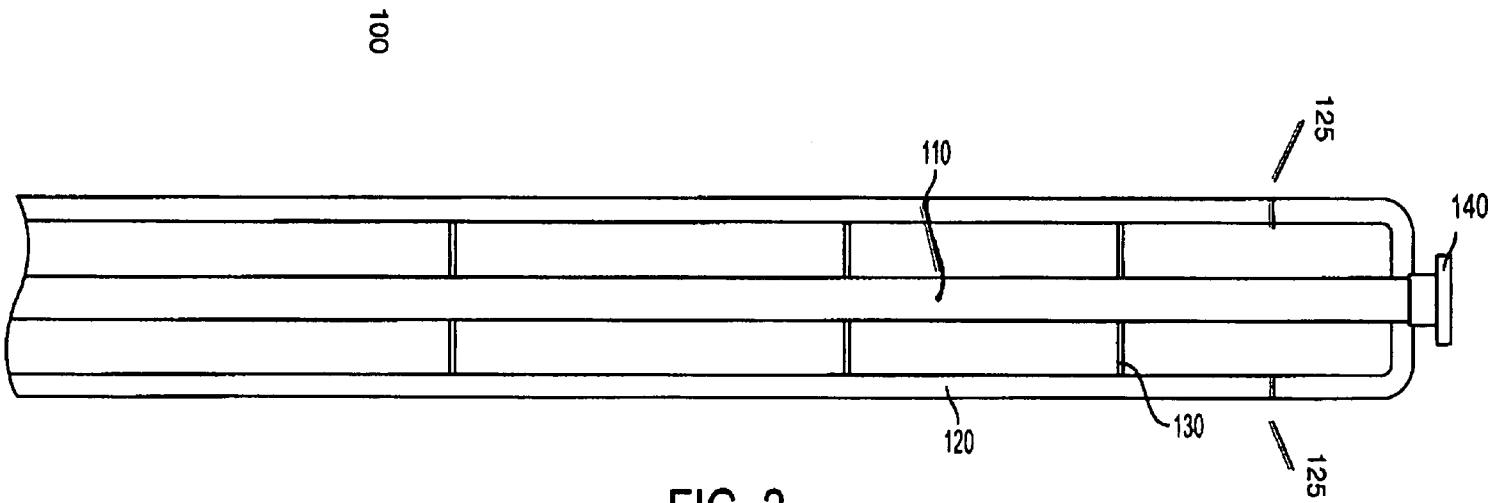
FIG. 2 illustrates a lower rectangular loop shower curtain rod mounted to an upper rod according to an embodiment of the invention.

FIG. 2 further illustrates the operation of the lower rectangular "loop-shaped" shaped bar 120. The lower rectangular "loop-shaped" bar 120 hangs from and below the straight horizontal bar 110 via the use of "J" hooks 130. The "J" hooks attach to the straight horizontal bar 110 along the upper edge of the "J" hooks and the lower edge of the horizontal bar 110. Correspondingly, the lower, hook portion of the "J" hooks attach to the rectangular "loop-shaped" bar along a lower surface of the lower rectangular "loop-shaped" bar 120.

Figure 3:
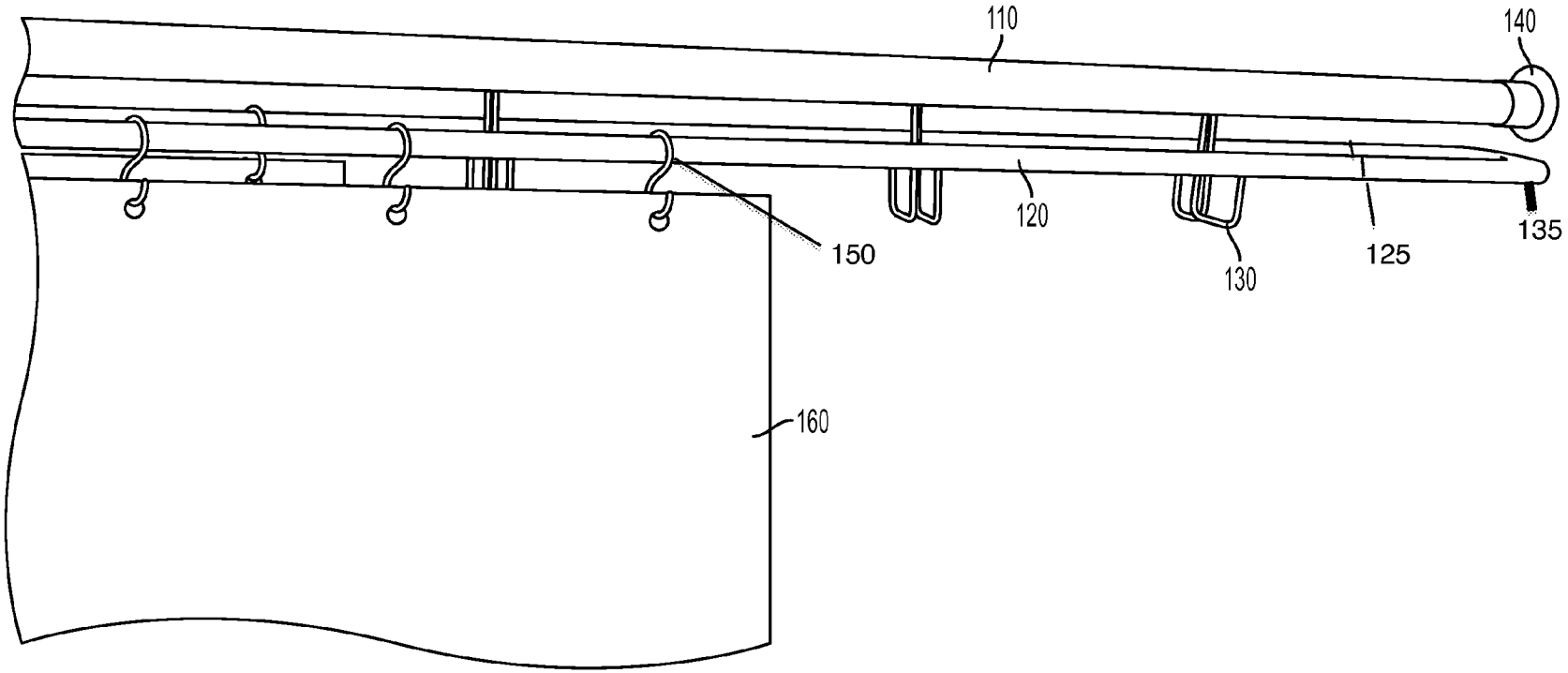
FIG. 3 illustrates a lower rectangular loop bar with shower curtains mounted via "S" hooks according to an embodiment of the invention.

FIG. 3 further illustrates curtains can be hung onto the lower rectangular "loop-shaped" bar 120 using "S" hooks 150, for example. The "S" hooks 150 hang from an upper surface of the lower rectangular "loop-shaped" bar 120 and do not interfere or come into contact with the attachment of the "J" hooks along the lower surface of the lower rectangular loop bar 120. This allows the "S" hooks 150 and anything hanging from the "S" hooks 150 to traverse the entire 360-degree outer edge of the lower rectangular "loop-shaped" bar 120. Therefore, curtains 160 or a shower curtain liner 160 hanging from the "S" hooks 150 can traverse the entire outer 360 degree perimeter of the lower rectangular "loop-shaped" bar 120.

The shower curtain 160 can be pulled along the outer 360-degree perimeter of the lower rectangular "loop-shaped" bar 120 to allow the wet side of the curtain 160 to face out into the bathroom for faster drying due to lower humidity and increased airflow. This operation facilitates faster drying of the shower curtain 160 and will reduce the opportunity for mold and mildew to set up. This operation allows the inner lining side of the shower curtain 160 to be quickly inspected for mold, mildew, or other damage as well. All of these factors will prevent or help prevent mold from forming on the shower curtain and/or liner 160. Furthermore, this operation will facilitate quicker cleaning of the shower curtain 160 by allowing a user to clean the curtain 160 while standing in the bathroom as opposed to having to stand in the bathtub to access the "wet" side of the shower curtain 160.

The upper horizontal bar 110 can be an adjustable, straight, curved or spring-loaded telescopic tension rod. Similarly, the lower rectangular "loop-shaped" bar 120 can have a variety of shapes including, curved, rectangular, oval, circular, semi-circular, etc. The upper horizontal bar 110 can also be mounted to the sidewalls using a quick release cradle such as described in FIG. 6 below. Furthermore, the lower rectangular "loop-shaped" bar 120 can have a variety of shapes including, a flat disc, rectangular, oval, circular, semi-circular, curved, etc. Similar to the upper horizontal bar 110, the lower "loop-shaped" bar can be adjustable to remain operable in bath and shower stalls of varying widths and to allow the shower curtain to be extended out for drying purposes and to be retracted or compressed when the curtain is being rotated around the loop. In particular, the lower, rectangular "loop-shaped" bar 120 is length-wise adjustable 125 and can be adjusted using the thumb pull 135. In an embodiment, the lower, rectangular "loop-shaped" bar 120 can be length-wise telescopically adjustable 125 at either the right end, left end or both. Again, pulling and/or pushing on the thumb pull 135 can make these adjustments.

Figure 4:
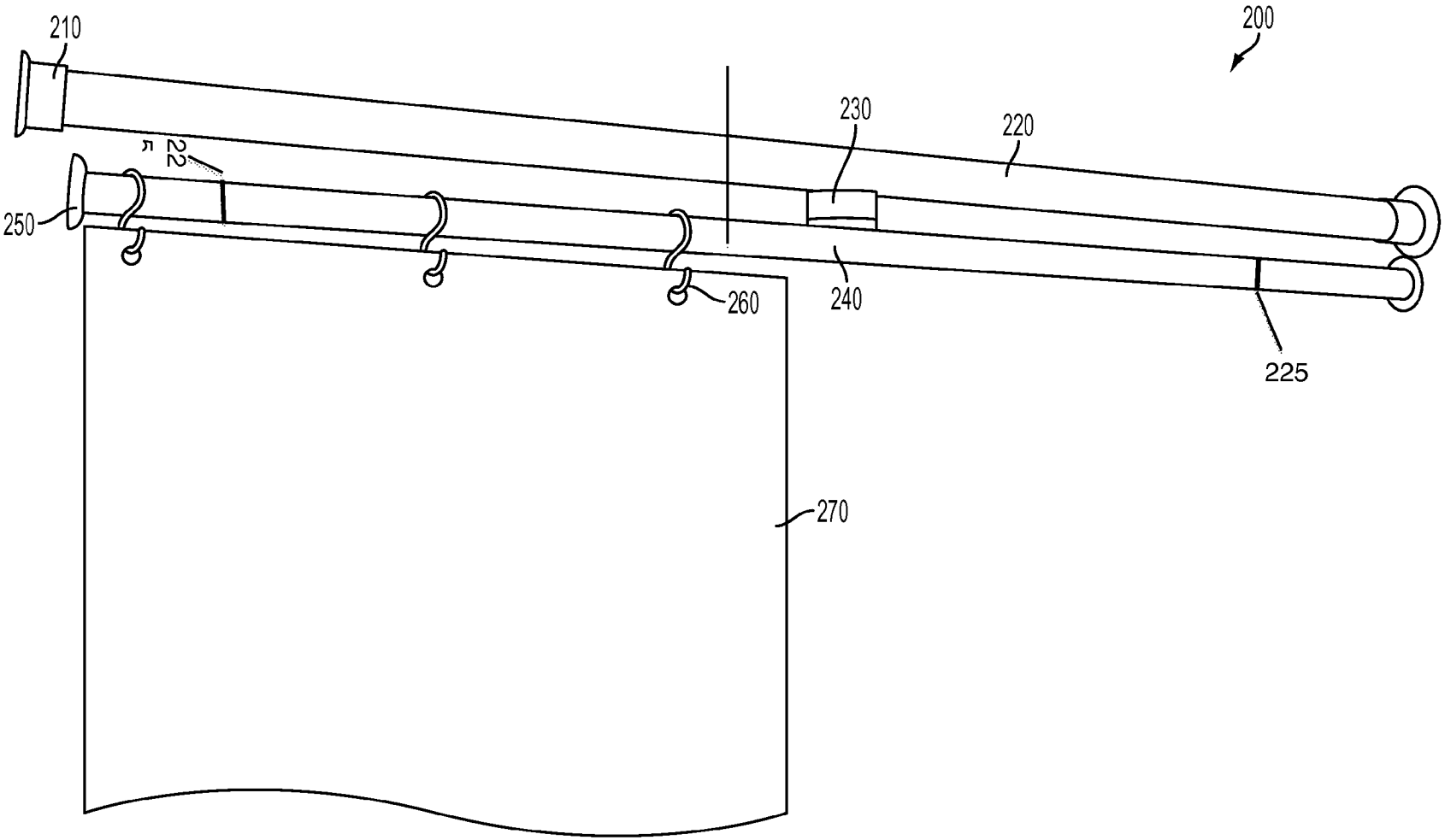
FIG. 4 illustrates a shower curtain rod having an upper mounting rod, a pivot mechanism, and a lower shower curtain-mounting rod that can rotate 180 degrees or more according to an embodiment of the invention.

FIG. 4 illustrates another embodiment of the shower curtain rod 200. Embodiments further include a shower curtain rod 200 having an upper straight horizontal rod 220 extended between and mounted to the sidewalls of the shower stall using mounting cradles 210. In an embodiment, the mounting cradles 210 can be one of the mounting cradles 310 described in FIG. 6 below. In another embodiment, the upper straight horizontal rod 220 can be a tension rod with rubber (or other malleable material) ends for gripping the sidewalls of the shower stalls and fixedly holding the shower curtain rod 200 in place. In still another embodiment, the upper straight horizontal rod 220 can be fixedly held in place using bolts, screws or similar fastening mechanisms or a combination of a tension rod mounted to the sidewalls with bolts and/or screws. The shower curtain rod 200 further includes a second, lower curtain-hanging rod 240 that is attached to the upper horizontal rod 220 via a pivot mechanism 230 mounted near the center of both the upper horizontal rod 220 and the lower curtain-hanging rod 240. The lower, curtain-hanging rod 240 is adjustable 225 in order to remain operable in shower stalls of varying widths and to allow the rod to be adjusted in or compressed, then rotated 180 degrees and extended out again for drying purposes and ease of operation. This adjustment can also aid in very small or cramped bathrooms where space is tight. In an embodiment, the pivot mechanism 230 can be a single "J" hook that rotates along its upper edge, while connecting to the lower, curtain-hanging rod 240 along its lower edge. This embodiment would allow "S" hooks on the lower rod to traverse the entire length of the curtain-hanging rod 240 without abutting the pivot mechanism 230.

Further illustrated in FIG. 4, the lower, curtain-hanging rod 240 is designed to receive a shower curtain 270 mounted to the rod 240 via curtain hooks or "S" hooks 260. The lower, curtain-hanging rod 240 further includes stoppers 250 that prevent the shower curtain 270 and hooks 260 from sliding off the lower, curtain-hanging rod 240 as it is rotated. The lower, curtain-hanging rod 240 swings up to 360 degrees relative to the upper horizontal rod 220 about the pivot mechanism 230. Therefore, the lower, curtain-hanging rod 240 allows the shower curtain 270 and/or liner 270 to be rotated through a full 360 degrees about the pivot mechanism 230. Therefore, the shower curtain 270 or liner 270 can be rotated within the bathtub or shower stall so that the wet, inner-stall facing side of the shower curtain 270 or liner 270 can be rotated 180 degrees to face out into the dryer and lower humidity area of the bathroom.

Figure 5:
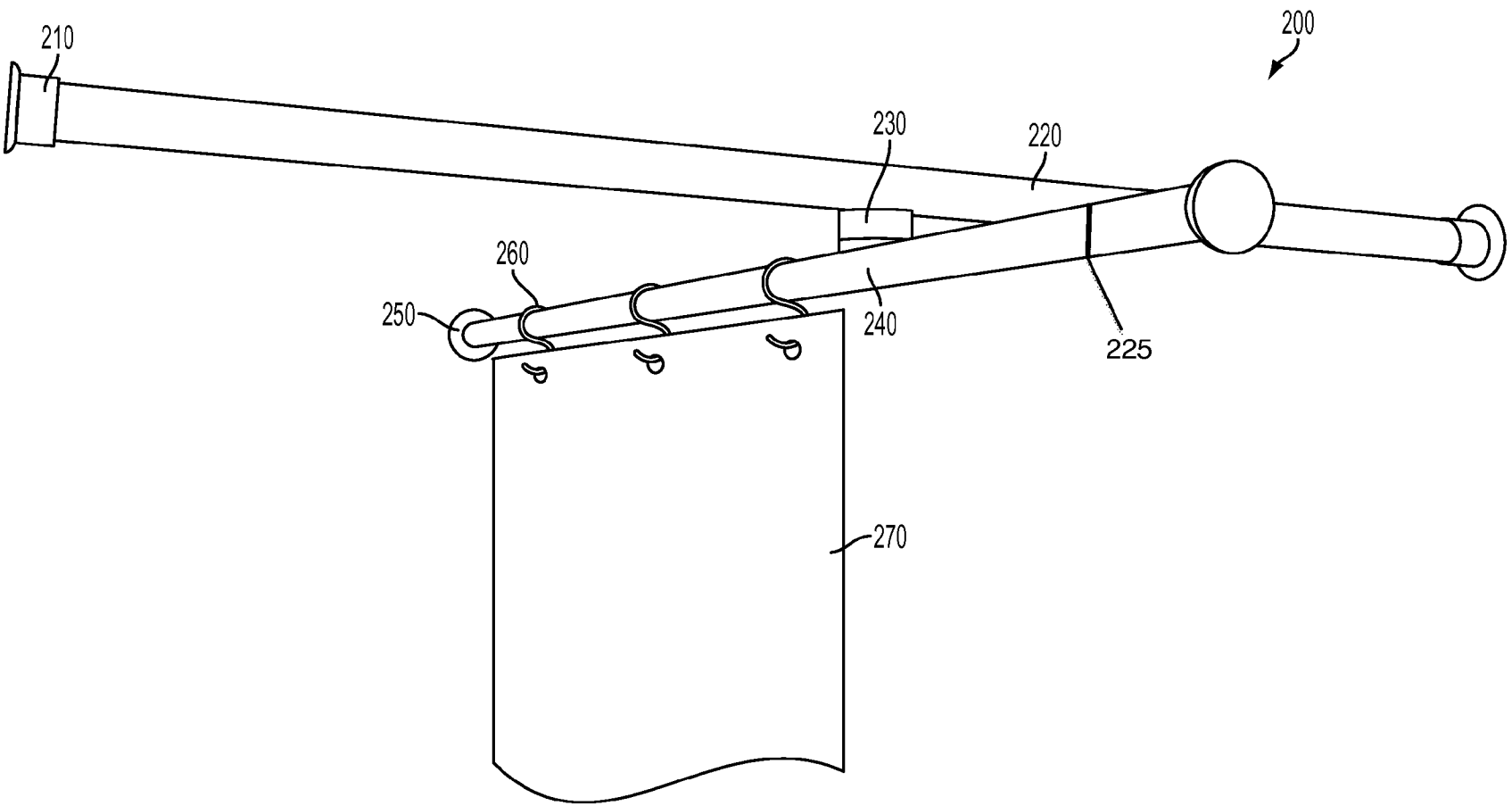
FIG. 5 illustrates a lower shower curtain mounting rod rotated through 180 degrees according to an embodiment of the invention.

FIG. 5 further illustrates the shower curtain rod 200 in operation and at half pivot relative to the upper horizontal rod 220. The lower, curtain-hanging rod 240 turns about the pivot mechanism 230. The pivot mechanism can have stops embedded into its operation that allow the lower, curtain-hanging rod 240 to fixedly stop at a plurality of positions. These embedded stops can allow the lower, curtain-hanging rod 240 to be placed in a variety of positions for cleaning, for drying and/or for mounting curtains 270. The adjustable feature of the rod 200 is designed so that the rotation of the lower, curtain-hanging rod 240 has enough clearance in the bath-stall area to rotate fully without coming into contact with the shower stall walls or the shower faucet. The hook stoppers 250 can be removably mounted to the lower, curtain-hanging rod 240 to allow curtains 270 and curtain hooks 260 to be quickly and easily mounted or removed from the rod 240.

The upper horizontal rod 220 can be an adjustable, straight, bowed or spring-loaded telescopic tension rod. Similarly, the lower rectangular bar 240 can have a variety of shapes including, a flat disc, rectangular, oval, circular, semi-circular, etc. The upper horizontal rod 220 can also be mounted to the sidewalls using a quick release cradle such described in FIG. 6 below.

Figure 6:
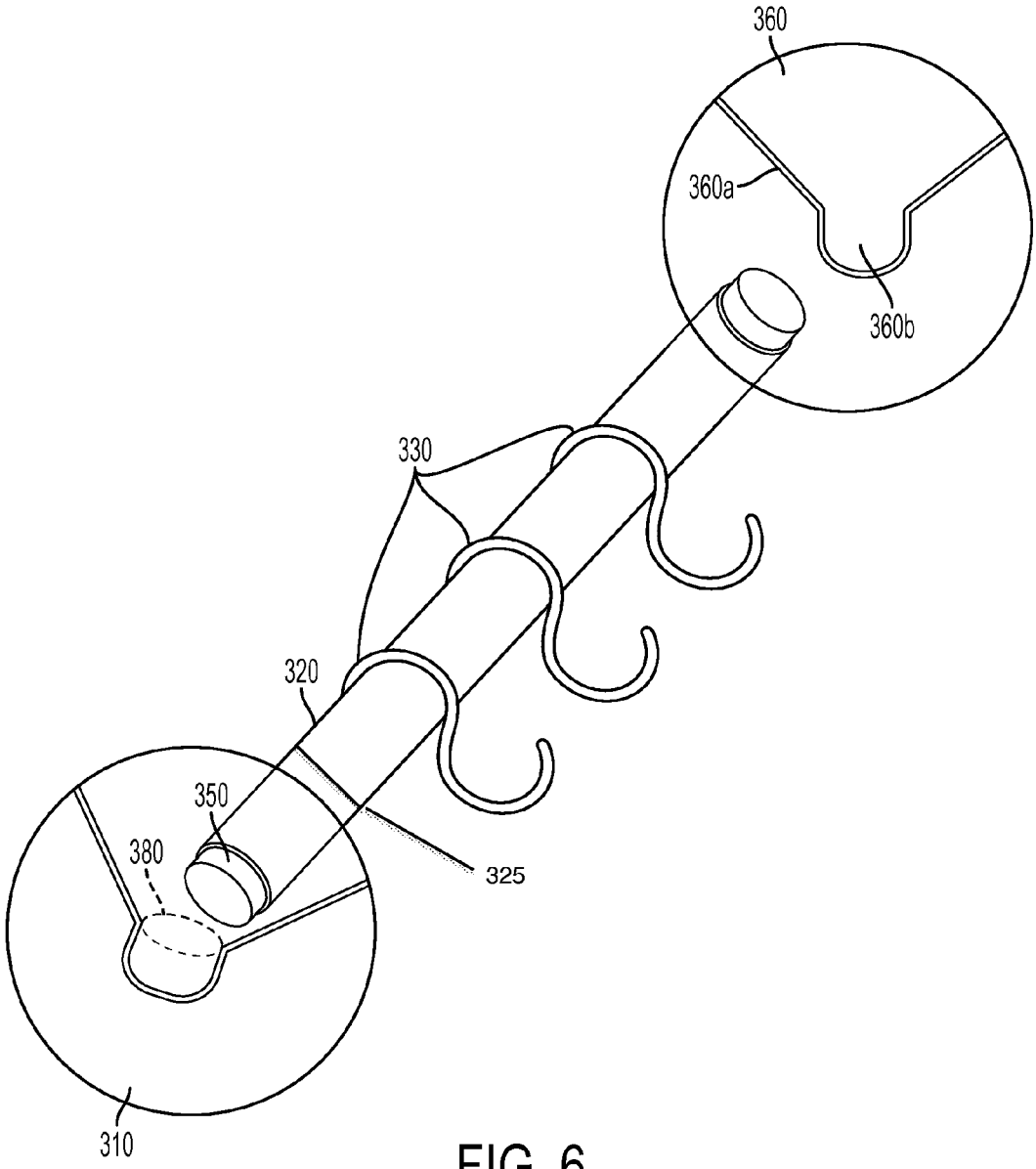
FIG. 6 illustrates a shower curtain rod mounted on quick release cradles mounted between the sidewalls of the shower stall according to an embodiment of the invention.

FIG. 6 illustrates still another shower curtain rod 300 according to an embodiment of the invention. The embodiment in FIG. 6 illustrates a rod 320 for receiving a shower curtain and shower curtain hooks 330. The shower curtain rod 320 is mounted in quick release cradles 310. The quick release cradles 310 are designed for mounting on opposite walls of the shower stall. The cradle portion 360 of the quick release cradles can comprise a modified "U" shape with flared side of the "U." The Flared sides 360*a* of the "U" allows the rod 320 to roll into and out of a cradle rest 360*b* in the cradle mount 360.

The shower curtain rod 320 is mounted between the sidewalls of the shower stall using the pair of quick release cradles 360. The quick release cradles 360 are designed to allow the shower curtain rod 320 to be securely mounted to the sidewalls of the shower stall, while also allowing the shower curtain and rod 320 to be quickly and easily removed from the cradles 360 and spun around 180 degrees by the user so that the shower curtain can be remounted with the wet inner-stall facing side of the shower curtain or liner and face out into the dryer and lower humidity area of the bathroom. The shower curtain rod 320 is length-wise adjustable 325 to accommodate shower stalls of varying widths.

In an exemplary embodiment, the shower curtain is mounted on the curtain rod 320 using shower curtain hooks 330. The rod 320 has stoppers 350 at either end which function to the keep the shower curtain and hooks 330 from sliding off the shower curtain rod 320 when it is removed from the cradles 360.

In still another embodiment, quick release cradles 360 are provided for a conventional shower curtain rod 320. The quick release cradles 360 are designed to receive a simple shower curtain rod 320 along a top edge 360*a*, while allowing the shower curtain rod 320 to rest in an indentation 360*b* of the quick release cradles. The indentation 360*b* limits the movement of the curtain rod 320 to only the vertical plane, limiting its ability to fall-out of the cradle. In another embodiment, the shower curtain rod 320 is an adjustable telescoping tension rod. The adjustable telescoping rod 320 engages the left and right quick release cradles 360 for a snug fit. In an embodiment, the tension adjustable rod 320 is spring-loaded and adds an extra level of sturdiness by forcibly pressing against left and right quick release cradles 360 when mounted in the cradles. In another embodiment, the quick release cradles 360 can provide an extra level of restraint by having spring-loaded disks 380 within the cradle rests 360*b*. In this embodiment, the spring-loaded disks can forcibly compress against the shower curtain rod 320 so that it remains in place until a greater force removes it. In another embodiment a spring loaded claw fastener can be employed in the cradle rest 360*b* to clamp down on the shower curtain rod 320 to hold it in place once it is mounted in the cradle rests 360. In still another embodiment, the cradle rest 360*b* can include screw threads for engagement with corresponding screw threads on the shower rod 320 for locking the rod 320 in place. In another embodiment, the telescoping tension rod includes a spring loaded tip at one or both ends that snaps into corresponding receptacles in the quick release cradles. If the tension rod has one spring loaded tipped end, the spring loaded tipped end engages an indentation in the quick release cradles. If both ends of the tension rod have a spring loaded tipped end, then a release mechanism for releasing the spring loaded tipped ends from the quick release cradles can be included.

While the invention has been described in terms of exemplary embodiment, those skilled in the art will recognize that the invention can be practiced with modifications in the sprit and scope of the appended claims. These examples given above are merely illustrative and are not meant to be an exhaustive list of all possible designs, embodiments, application or modifications of the invention. For example, the dimensions of various components of the rods illustrated in FIGS. 1-6 can vary in relation to each other as needed, for example, for stability. In an embodiment, the upper supporting rods of FIGS. 1 and 4 can have larger or smaller diameters in relation to the lower rods that they support. The "J" hooks described in FIGS. 1-6 can have varying designs that are more trapezoidal in shape than the specific "J" design. Therefore the use of the term "J" here is exemplary only. Similarly, the use of the term "S" hook may also be exemplary only as other trapezoidal designs can accomplish the same function. Furthermore, "J" and "S" hooks having ball-bearing designs can also be used. Similarly, the thumb pull 135, although shown to be triangular, can be any of a variety of shapes; such as curved to comfortably fit the users hand. Furthermore, the shower curtain design described in FIGS. 1-6 can comprise a variety of materials and combinations including metal, plastic, wood, rubber and the like.

The methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A shower curtain rod assembly for hanging a shower curtain across a shower or bath stall opening between opposite sidewalls, the shower rod assembly comprising:

an upper bar extended between and mounted to the sidewalls of the opening;

a second, loop bar suspended from and hanging below the upper bar, wherein the loop bar is length wise adjustable, and wherein the loop bar receives a plurality of hooks for mounting a shower curtain such that the loop bar allows the shower curtain and/or liner to be pulled and rotated through a full 360 degrees around an outer edge of the loop bar.

2. The shower curtain rod assembly according to claim 1, wherein the loop bar is suspended from the upper bar using a plurality of "J" hooks.

3. The shower curtain rod assembly according to claim 2, wherein the plurality of "J" hooks attach to a lower surface of the loop bar while an upper end of the plurality of "J" hooks attaches to a lower surface of the upper bar.

4. The shower curtain rod assembly according to claim 3, wherein curtains are hung from the loop bar using one of more "S" hooks, wherein the "S" hooks can traverse an outer edge of the loop bar such that the shower curtains have a full 360 degrees of motion around the outer edge of the loop bar.

5. The shower curtain rod assembly according to claim 4, wherein the shower curtains can be rotated through 180 degrees along the outer edge of the loop bar such that the inner-facing wet side of the shower curtain can be positioned to face the outer-bathroom area and away from the shower stall.

6. The shower curtain rod assembly according to claim 1, wherein the horizontal rod is fixedly mounted at each end to the sidewalls.

7. The shower curtain rod assembly according to claim 1, wherein the upper rod is mounted at each end to the sidewalls by engaging quick release mounting cradles.

8. The shower curtain rod assembly according to claim 1, wherein the upper rod is an adjustable or telescoping tension rod.

9. A shower curtain rod assembly for hanging a shower curtain across an opening between opposing sidewalls, the shower rod assembly comprising:

an upper mounting rod extending between and mounted to the sidewalls of the opening;

a second, lower shower curtain rod is attached to the upper mounting rod at its center point via a pivot mechanism;

the lower, shower curtain rod is attached near its center point to the upper mounting rod; wherein the lower, shower curtain rod is lengthwise adjustable and wherein the lower, shower curtain rod has the ability to swing 360 degrees relative to the upper mounting rod about the pivot mechanism.

10. A shower curtain rod assembly according to claim 9, wherein the pivot mechanism includes a series of stops from holding the lower shower curtain rod in various position through out its 360 degrees of rotation.

11. A shower curtain rod assembly according to claim 9, wherein a wet inner-stall facing side of the shower curtain attached to the lower shower curtain rod can be rotated so that it faces out into a dryer and lower humidity area of a room.

12. The shower curtain rod assembly according to claim 9, wherein the upper mounting rod is fixedly mounted at each end to the sidewalls.

13. The shower curtain rod assembly according to claim 9, wherein the mounting rod is removably mounted at each end to the sidewalls.

14. The shower curtain rod assembly according to claim 9, wherein the lower shower curtain rod has removable end caps for retaining a shower curtain in place.

15. The shower curtain rod assembly according to claim 9, wherein the mounting rod is a telescoping rod.

16. The shower curtain rod assembly having quick release cradles comprising:

quick release cradles for fixable attachment to opposite sidewalls of a shower opening;

a horizontal shower curtain rod designed to engage the quick release cradles at its opposite ends, wherein the quick release cradles allow the shower curtain rod to be removed and rotated 180 degrees and remounted.

17. The shower curtain rod assembly having quick release cradles according to claim 16, wherein the shower curtain rod is a lengthwise adjustable rod.

18. The shower curtain rod assembly having quick release cradles according to claim 16, wherein the telescoping rod includes a spring loaded tip at one end that snaps into place once it is placed into the quick release cradle.

19. The shower curtain rod assembly having quick release cradles according to claim 16, wherein the telescoping rod includes a spring loaded tip at both ends that snaps into place once it is placed into the quick release cradles and a release mechanism for releasing the spring loaded tips from the quick release cradles.

20. The shower curtain rod assembly having quick release cradles according to claim 16, wherein the curtain rod has removable end caps for retaining a shower curtain in place.

* * * * *